United States Patent [19]

Neidhardt

[11] Patent Number: 4,579,028

[45] Date of Patent: Apr. 1, 1986

[54] ONION DICER

[76] Inventor: Edward M. Neidhardt, 933 Haver Dr., Hicksville, Ohio 43526

[21] Appl. No.: 637,501

[22] Filed: Aug. 1, 1984

[51] Int. Cl.[4] ..... B26D 3/22

[52] U.S. Cl. ..... 83/109; 83/133; 83/356.3; 83/408; 83/425.3; 83/437; 83/857

[58] Field of Search ..... 83/408, 355, 356.3, 83/857, 437, 734, 130, 133, 136, 906, 125, 425.1, 109, 425.3

[56] References Cited

U.S. PATENT DOCUMENTS

| | | | |
|---|---|---|---|
| 465,840 | 12/1891 | Dewes et al. | 83/136 X |
| 940,063 | 11/1909 | Reenstierna | 83/437 |
| 1,320,206 | 10/1919 | Cohen | 83/133 X |
| 1,703,553 | 2/1929 | Slaten | 83/437 X |
| 1,744,795 | 1/1930 | Powell | 83/425.1 |
| 2,299,092 | 10/1942 | Johnson | 83/437 X |
| 2,466,291 | 4/1949 | Williams | 83/133 |
| 3,091,269 | 5/1963 | Burns et al. | 83/437 X |
| 4,463,643 | 8/1984 | Bettcher | 83/437 X |

FOREIGN PATENT DOCUMENTS

| | | | |
|---|---|---|---|
| 118973 | 9/1918 | United Kingdom | 83/136 |

*Primary Examiner*—Frank T. Yost
*Attorney, Agent, or Firm*—Harvey B. Jacobson

[57] ABSTRACT

A stationary grid of crossed blade members is provided and force structure is movable toward and away from one side of the grid and operative to engage a farm commodity such as an onion and gradually move the onion toward the grid. Knife structure is supported relative to the grid for repeating movement in a plane generally paralleling and slightly spaced outward of the other side of the grid and across the latter. Drive structure is operatively connected to the knife structure for repeated movement of the latter across the grid at a speed proportional to the speed of movement of the force structure toward the grid. The force structure includes a plate paralleling the grid and spaced outwardly of the aforementioned one side thereof. The plate includes a plurality of blunted pins projecting outward therefrom toward the grid and projectable into the spaces defined between adjacent portions of the crossed blade members of the grid. An extraction plate having a plurality of openings formed therethrough is mounted on the pins for frictionally resisted sliding movement therealong and the extraction plate is engageable with the grid for shifting of the extraction plate toward the base ends of the pins. In addition the extraction plate includes abutment pins which project through openings provided therefor in the force structure and whose free ends are engageable with abutment surface portions to shift the extraction plate toward the free ends of the blunted pins upon movement of the force plate to a predetermined position away from the grid.

7 Claims, 12 Drawing Figures

ONION DICER

BACKGROUND OF THE INVENTION

Many fast food and other restaurants utilize large quantities of diced onions and it requires appoximately five hours of manual labor to dice 100 pounds of onions of medium size. However, manual dicing of onions may be more effectively carried out by utilizing more expensive jumbo size onions which cost approximately $3.00 more per 100 pounds than medium size onions. Accordingly, considerable expense is involved in dicing 100 pounds of onions. Therefore, a need exists for an apparatus by which onions may be diced in a more efficient manner.

Various different forms of farm commodity slicing and dicing mechanisms heretofore have been provided such as those disclosed in U.S. Pat. Nos. 1,449,040, 1,744,795, 1,931,982, 2,056,843, 2,156,645, 2,299,092, 2,341,582, 2,446,993, 2,508,868, 2,692,629, 3,211,202, German Pat. No. 223,035 and French Pat. No. 575,059. However, few of these previously known devices are actually capable of dicing farm commodities such as onions. Accordingly, a need exists for an apparatus by which onions may be quickly and efficiently diced.

BRIEF DESCRIPTION OF THE INVENTION

The onion dicer of the instant invention defines an elongated horizontal upwardly opening trough at one end of which a grid of crossed cutting blades is removably mounted and a pusher plate is mounted for back-and-forth movement between the grid and the other end of the trough. The pusher plate removably supports a force plate therefrom including a plurality of blunted pins projecting outwardly therefrom toward the grid and receivable in the spaces between crossed blades of the grid upon movement of the pusher and force plates toward the grid. A farm commodity such as an onion may be supported within the trough between the grid and the force plate and structure is provided for controlled movement of the pusher plate, and thus the force plate, toward the grid in order to force the onion through the grid. A rotary cutter is mounted on the side of the grid remote from the force plate and includes cutting blade structure for cutting those portions of the onions forced through the grid. As the force plate approaches the grid during the process of forcing an onion through the grid the blunted pins of the force plate engaged with those portions of the onion aligned with the spaces between crossed blades of the grid push those onion portions through the grid for complete dicing of the onion. In addition, an extraction plate is provided and includes openings formed therethrough. The extraction plate is mounted upon the pins of the force plate intermediate the base and free ends of the pins and is slidable along the latter, in frictional engagement therewith, between a retracted position closely opposing the force plate and an extraction position substantially flush with the outer ends of the blunted pins. The extraction plate includes abutment pins supported therefrom which project through the force and pusher plates and are engageable with abutment portions of the dicer to shift the extraction plate from its retracted position to its extraction position responsive to final movement of the pusher plate away from the grid to a predetermined position spaced therefrom. The extraction plate is further engageable with the grid upon projection of the blunted pins therethrough in order to shift the extraction plate from the free ends of the pins back toward the base ends of the pins as the pusher plate is moved toward the grid. Accordingly, the extraction plate is retractable from the free ends of the blunted pins as an onion is being finally forced through the grid and yet is movable back to the free ends of the blunted pins upon retraction of the pusher and force plates away from the grid in order to strip any remaining particles of the last diced onion which may be clinging to the blunted pins.

The pusher plate is advanced toward and away from the grid by a screw shaft and the same screw shaft is drivingly coupled to the rotary cutter. In this manner, the cutting action of the rotary cutter on those portions of an onion forced through the grid is controlled at a rate proportional to the rate of advancement of the onion portions through the grid.

The main object of this invention is to provide an apparatus which will enable the rapid dicing of farm commodities such as onions.

Another object of this invention is to provide a dicer constructed in a manner whereby the various components thereof contacting the commodity to be diced may be readily removed and cleaned.

Still another object of this invention is to provide a dicer which may be used to dice relatively fragile farm commodities.

A final object of this invention to be specifically enumerated herein is to provide a dicer in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
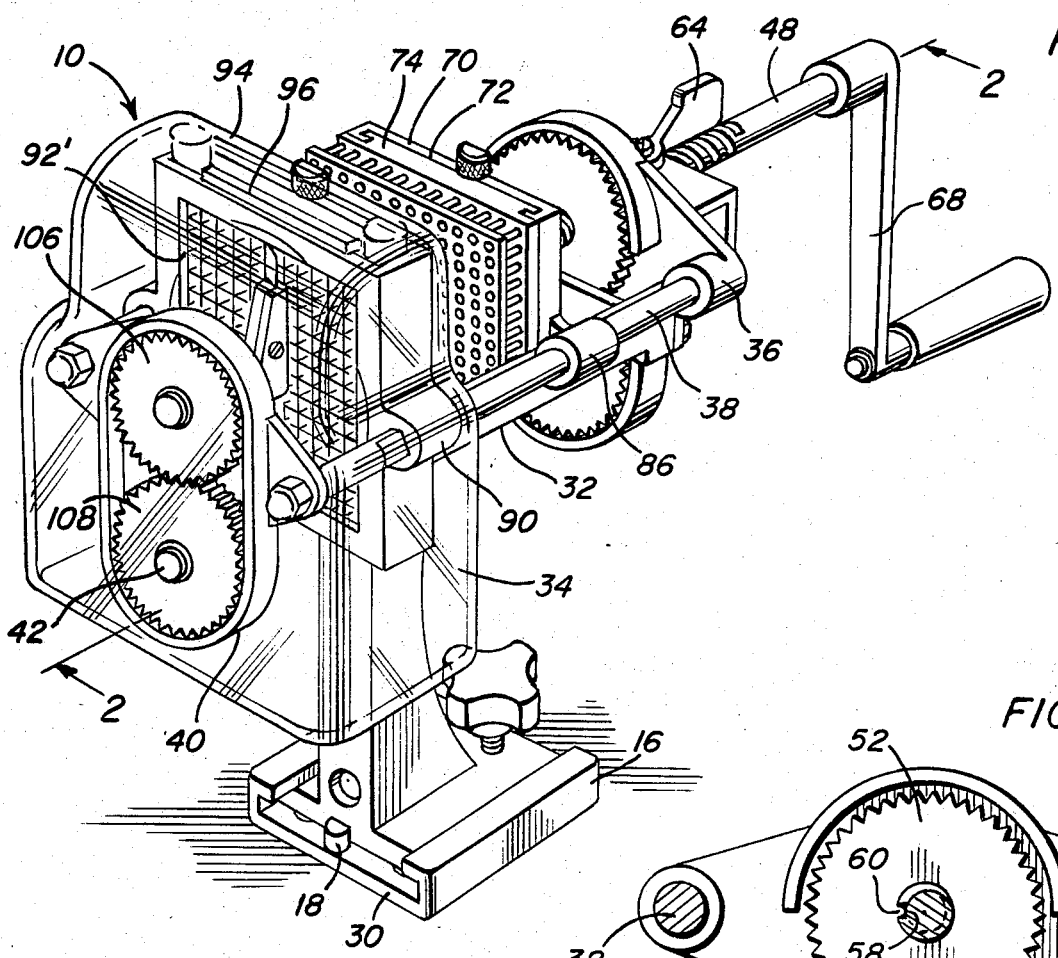
FIG. 1 is a perspective view of the dicer.

Referring now more specifically to the drawings the numeral 10 generally designates the commodity dicer of the instant invention. The dicer 10 has been specifically designed for dicing onions, but also may be used for dicing other farm commodities.

The dicer 10 includes an upright standard 12 including a horizontally enlarged mounting flange 14 on its lower end. A channel-shaped mounting bracket 16 slidingly receives the mounting flange 14 therein to a point with the mounting flange 14 abutted against an upwardly projecting abutment 18 carried by the mounting bracket and the mounting bracket 16 may be secured to any suitable horizontal support surface 20 by conventional screws or other fasteners 22. The mounting flange 14 includes a vertical threaded bore 24 formed therethrough and a finger-engageable knob-equipped setscrew 26 is threadingly secured through the bore 24 and is seatingly engageable in an upward opening recess 28 formed in the bight portion 30 of the mounting bracket 16 through which the fasteners 22 are secured.

The upper end of the standard mounts a horizontal commodity supporting and guiding trough 32 therefrom and front and rear plates 34 and 36 are removably mounted on the front and rear ends of the trough 32 and opposite side front-to-rear extending guide bars 38 are supported from and extend between corresponding opposite side portions of the plates 34 and 36 and include forward ends which project forwardly of the front plate 34 and support a front bearing plate 40 therefrom.

A jack shaft 42 is disposed closely beneath the trough 32 and includes a rear end journaled from the rear plate 36 and a front end journaled from the bearing plate 40, rear and front gears 44 and 46 being mounted on the shaft 42 and including shoulder portions journaled in the plates 36 and 40.

Figure 12:
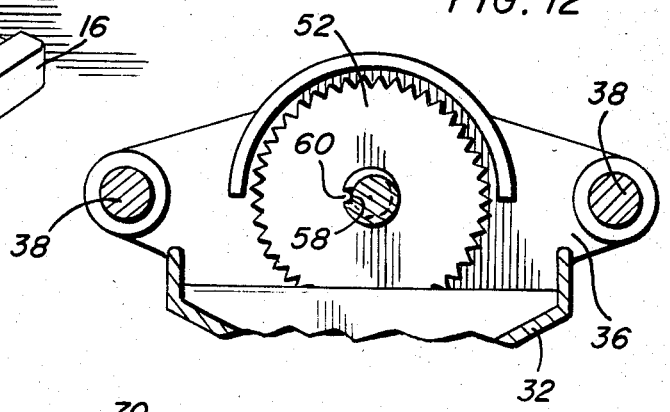
FIG. 12 is a transverse vertical sectional view taken substantially upon the plane indicated by the section line 12—12 of FIG. 2.
Figures 3, 4, 5, 6, 7, 8, 9, 10:
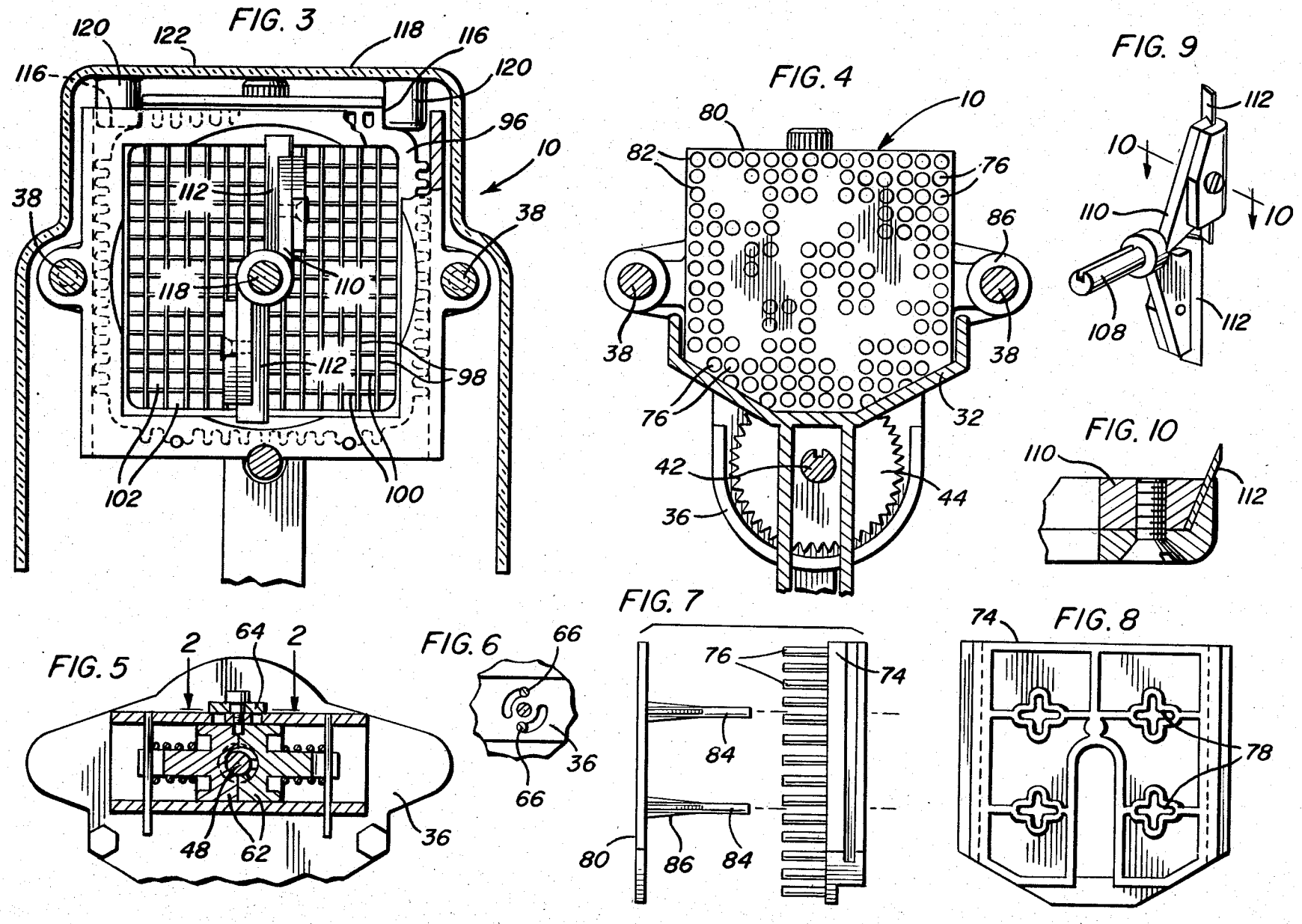
FIG. 3 is a transverse vertical sectional view taken substantially upon the by the section line 3—3 of FIG. 2.
FIG. 4 is a fragmentary transverse vertical sectional view taken substantially upon the plane indicated by the section line 4—4 of FIG. 2.
FIG. 5 is a fragmentary vertical sectional view taken substantially upon the plane indicated by the section line 5—5 of FIG. 2.
FIG. 6 is a fragmentary horizontal sectional view taken substantially upon the plane indicated by the section line 6—6 of FIG. 5.
FIG. 7 is a side elevational view of the blunted pin-equipped force plate and the extraction plate with the two plates illustrated in relatively exploded positions.
FIG. 8 is an elevational view of the force plate as seen from the right side of FIG. 7.
FIG. 9 is a perspective view of the rotary cutter.
FIG. 10 is an enlarged fragmentary horizontal sectional view taken substantially upon the plane indicated by the section line 10—10 of FIG. 9.

A feed screw shaft 48 is slidably and rotatably supported from the rear plate 36 by a rear bushing 50 and a drive gear 52 including a shoulder portion 54 is journaled from the rear plate 36. The feed screw shaft 48 is threaded as at 56 and includes a longitudinal keyway 58, see FIG. 12. The drive gear 52 includes a key 60 loosely slidable in the keyway 58 and accordingly, the feed screw shaft 48 is keyed to the drive gear 52 against rotation relative thereto, but is longitudinally slidable relative to the drive gear 52. The lower periphery of the drive gear 52 is meshed with the upper periphery of the rear gear 44 and a pair of spring-biased half nut members 62, see FIG. 5, are slidingly supported from an upper rear portion of the rear plate 36 immediately forward of the bushing 50 and establish a threaded connection between the screw shaft 48 and the rear plate 36 whereby rotation of the screw shaft 48 relative to the rear plate 36 will cause longitudinal displacement of the shaft 48 through the rear plate 46. However, a cam lever 64 is pivotally supported from the rear plate 36 and includes a pair of depending pin portions 66 engaged with the opposing ends of the nut members 62 and which may be angularly displaced relative to the rear plate 36 in order to effect retraction of the nut members 62 away from each other. When the nut members 62 are retracted away from each other and opposite side portions of the screw shaft 48 the nut members 62 are disengaged from the shaft 48 thereby allowing longitudinal shifting of the shaft 48 relative to the nut members 62.

The rear end of the shaft 48 is provided with a crank 68 and the front end of the shaft 48 is rotatably attached to a force plate 70. A shoulder screw 124, with a diameter slightly smaller than the center hole in the force plate, is passed through the force plate from the side opposite the shaft 48. It then passes through a nylon washer 125 and then through a stainless steel washer 126. The threaded end of the screw which is slightly smaller than the central diameter is threaded into a hole in the end of shaft 48. When shaft 48 is pulled backward, the head of screw 124 comes in contact with the front face of force plate 70, thus pulling it backward. When shaft 48 is rotated forward, the nylon washer 125 comes in contact with the back face of force plate 70, which is slidably and guidingly received within the trough 32, driving it forward. The force plate 70 does not rotate but slides forward within trough 32. The force plate 70 defines an upwardly opening guideway 72, see FIG. 1, in which a removable plate member 74 is removably received. The plate member 74 includes a plurality of vertically spaced horizontal rows of cylindrical abutment pins 76 projecting outwardly from the front side thereof and the outer ends of the pins 76 are blunted. The plate member 74 includes four rearwardly tapering cruciform openings 78 formed therethrough and an extraction plate 80 is provided and includes a plurality of vertically spaced horizontal rows of openings 82 formed therein through which the pins 76 are snugly and frictionally slidably received. Thus, the extraction plate 80 is mounted on the plate member 74 by the pins 76 for frictionally resisted shifting of the extraction plate 80 on the pins 76 between a retracted position carried by the base ends of the pins 76 and an extended position carried by the free ends of the pins 76. In addition, the extraction plate 80 may be displaced off of the free ends of the pins 76. Further, the extraction plate 80 includes four rearwardly projecting pins 84 including rearwardly tapering base end portions 86 which are seatingly receivable in the openings 78. When the extraction plate 80 is in its retracted position on the base ends of the pins 76 closely opposing the plate member 74, the pins 84 project rearwardly through the openings 78 and project rearwardly of the plate member 78 and through openings provided therefor in the force plate 70. Thus, the rear free ends of the pins 84 project rearwardly from the rear side of the force plate 70 in the manner illustrated in FIG. 11 of the drawings when the extraction plate 80 is in its retracted position on the base ends of the pins 76 closely opposing the plate member 74.

The force plate 70 includes opposite side outwardly projecting sleeve portions 86 slidably mounted on the guide bars 38 and it may be seen from a comparison of FIGS. 2, 4, 8 and 11 that the lower portions of the force plate 70 and the lower portions of the plate member 74 and extraction plate 80 closely conform to the cross-sectional shape of the trough 32.

When the cam lever 64 is swung to the right when viewing the dicer 10 from the rear end thereof, the nut members 62 are retracted from engagement with the shaft 48 and the latter may be pulled rearwardly until the sleeve portions 86 engage those opposite side portions of the rear plate 36 supporting the rear ends of the guide bars 38. However before rearward movement of the force plate 70 is terminated by engagement of the sleeve portions 86 with the opposite side portions of the rear plate 36, the rear ends of the pins 84 will engage the front side of the drive gear 52 and thus automatically shift the extraction plate 80 from its retracted position on the base ends of the pins 76 to the extended position of the extraction plate 80 illustrated in FIG. 2 of the drawings with the plate 80 having its front side substantially flush with the forward ends of the pins 76 and frictionally retained in the extended position.

The front plate 34 is in the form of a peripheral frame including opposite side sleeve portions 90 through which the guide bars 38 extend and defining a horizontal opening 92 therethrough. In addition, the front plate 34 defines an upwardly opening guideway 94 and a cutting grid assembly 96 including crossed vertical and horizontal rearwardly facing cutting blades 98 and 100 is removably downwardly receivable in the guideway 94 for support from the front plate 34. The openings 102 between adjacent portions of the crossed blades 98 and 100 are registered with the pins 76 and the latter are loosely receivable through the openings 102 from the rear ends thereof.

The bearing plate 40 supported from the forward ends of the guide bars 38 rotatably journals a driven gear 106 therefrom whose lower periphery is meshed with the upper periphery of the front gear 46 and a front-to-rear extending shaft 108 projects rearwardly through and beyond the center of the driven gear 106 and has a cutting head 110 mounted thereon including a pair of removably mounted oppositely angled and facing generally radially extending blade members 112 supported therefrom. Accordingly, upon rotation of the shaft 48 the drive gear 52 will drive the rear gear 44 thus causing rotation of the front gear 46 and the driven gear 106 and cutting head 110 with the blade members 112 being spaced slightly forward of the forward extremities of the crossed blades 98 and 100 of the cutting grid assembly 96.

The opposite upper side corners of the cutting grid assembly 96 are relieved as at 116 and a rearwardly and downwardly opening transparent shroud 118 is provided and includes downwardly projecting pins 120 supported from its top wall 122 which are removably downwardly received in the relieved areas 116 for supporting the shroud 118 in position enclosing the cutting grid assembly 96 and the swingable blade members 112.

Figure 11:
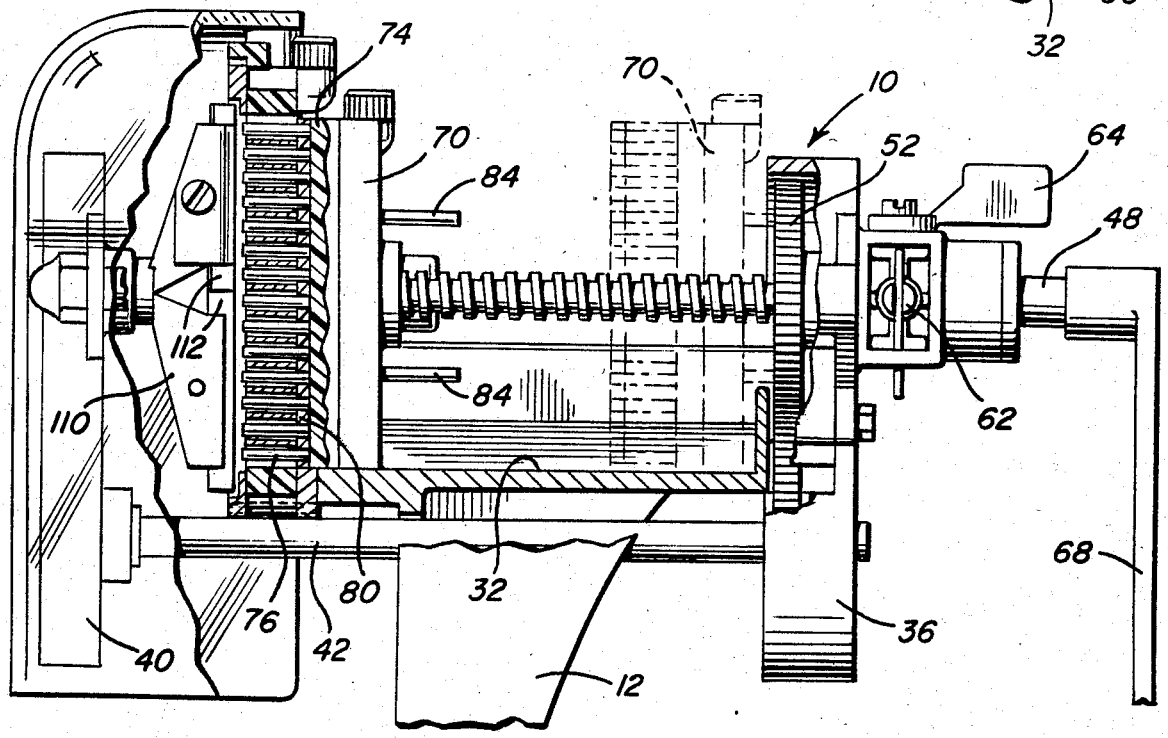
FIG. 11 is an enlarged fragmentary side elevational view of the dicer with portions thereof being broken away and illustrated in vertical section and alternate positions of the force and extraction plates illustrated in phantom lines.
Figure 2:
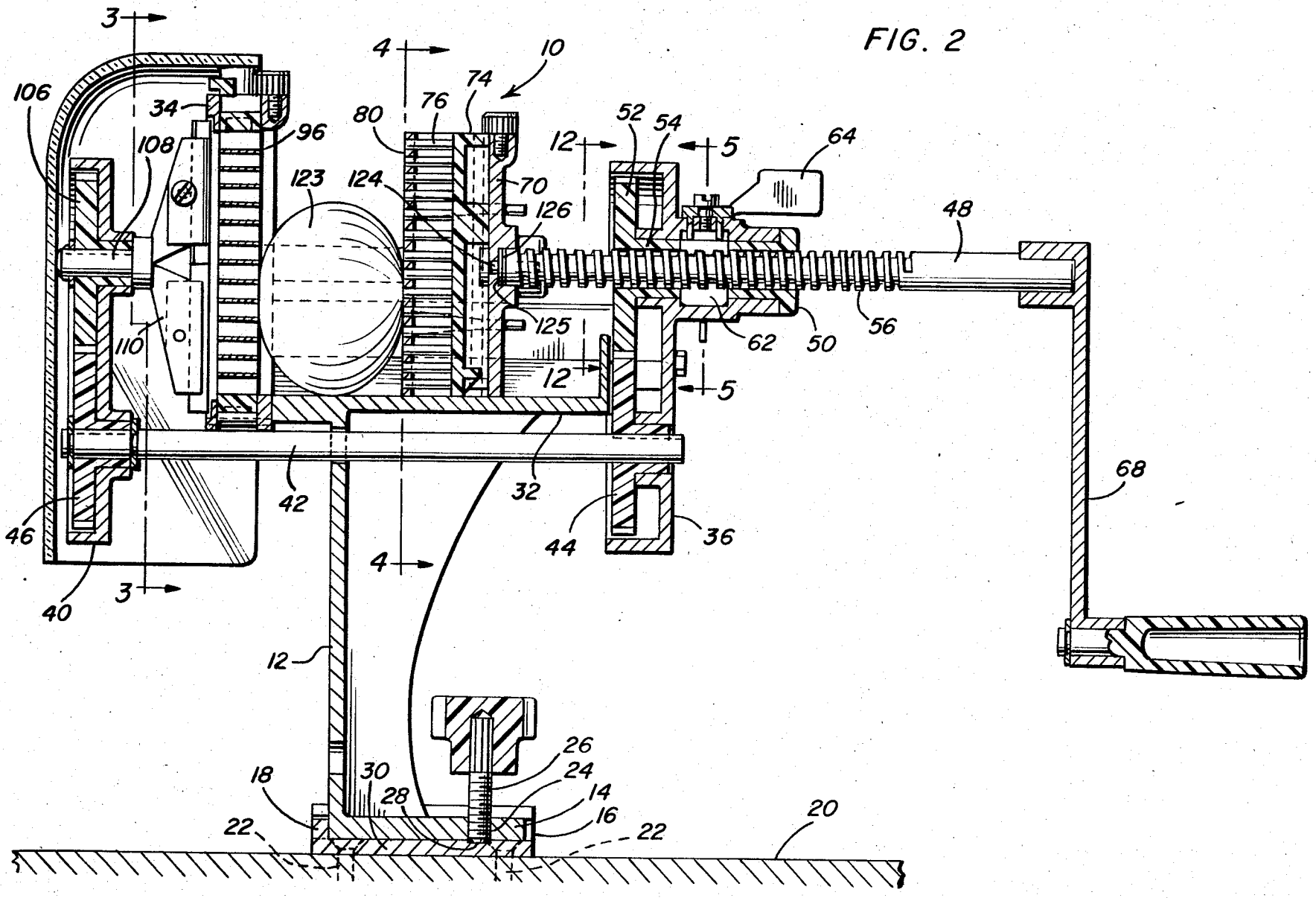
FIG. 2 is an enlarged fragmentary vertical sectional view taken substantially upon plane indicated by the section line 2—2 of FIG. 1.

In operation, and assuming that the dicer 10 is fully assembled as illustrated in FIG. 2, preparatory to placing an onion 123 in the trough 32 for dicing the onion, the rear end of the lever 64 is displaced to the right and a rearward pull is exerted on the crank 68 in order to slide the force plate 70 to its rearmost position illustrated in phantom lines in FIG. 11. The rear ends of the pins 84 carried by the extraction plate 80 thereby engage the front face of the gear 52 in order to shift the extraction plate 80 from its rearmost position to its forwardmost position on the free ends of the pins 76. Then, the onion 123 is placed within the trough 32 and the lever 64 is released so that upon turning of the crank 68 the shaft 48 will move slowly forwardly toward the cutting grid assembly 96. As the onion 123 is clamped between the free ends of the pins 76 and the cutting grid assembly 96 and the crank 68 is further rotated, the free ends of the pins 76 and the plate 80 force the onion through the cutting grid assembly 96. As the front portion of the onion 123 moves through and beyond the cutting grid assembly 96 the blades or blade members 112 cut the onion strips into substantially cube-shaped onion particles. If only one of the blade members 112 is used all six sides of the onion particles will have substantially the same dimensions. However, if two blade members 112 are used four of the sides of the cube shaped particles will be approximately one-half the area of the remaining two sides of the cube shaped particles. As the pins 76 and plate 80 approach the assembly 96 the plate 80 engages the assembly 96 and is stopped thereby while the pins 76 continue to move forwardly through the openings 102. In this manner, all of the onion is diced.

Thereafter, upon again swinging the rear end of the lever 64 to the right and pulling rearward on the crank 68, the force plate 70 and plate member 74 are retracted rearwardly from the cutting grid assembly 96 and engagement of the rear ends of the pins 84 with the front side of the drive gear 52 will cause the extraction plate 80 to be shifted to the free ends of the pins 76 and thereby strip any onion particles wedged between the pins 76 before a new onion 123 to be diced is placed within the trough 32 immediately rearward of the cutting grid assembly 96.

All of the components of the dicer 10 except for the bushing 50, the nut members 62, the plate member 74, the extraction plate 80 and the various gears are constructed of stainless steel for ease in cleaning. Further, the various gears, plate members 74 and extraction plate 80 may be constructed of plastic.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sliceable commodity dicer including a stationary grid of crossed blade members, manually operable force means shiftable along a predetermined path between first and second limit positions toward and away from one side of said grid and operative to engage a commodity item and gradually move said commodity item toward said one side of and through said grid from said one side thereof. knife means supported for repeated movement in a plane generally paralleling and slightly spaced outwardly of the other side of said grid and across the latter, and drive means operatively connected to said knife means for repeated movement of the latter across said grid at a speed proportional to the speed of movement of said force means toward said grid, said force means including force plate means generally paralleling said grid and spaced to said one side thereof, the side of said force plate means opposing said grid including a plurality of blunted pins projecting outwardly therefrom and projectable into the spaces defined between adjacent crossed portions of the blade members of said grid upon final movement of said force plate means toward said one side of said grid, extraction plate means having a plurality of openings formed therethrough, said extraction plate means being mounted on said pins between said grid and said force plate means and slidable on said pins between the opposite ends of the latter with said extraction plate means frictionally engaged with said pins to frictionally resist shifting of said extraction plate means along said pins, said extraction plate means being engageable with said grid to shift said extraction plate means along said pins from a position flush with the free ends of said pins toward the base ends thereof when said force means is moved to said first limit position, said extraction plate means including extraction pins projecting outwardly therefrom on the side thereof remote from said grid and projecting through openings provided therefor in said force plate means spaced between adjacent ends of said blunted pins, said dicer including abutment means engageable by the outer ends of said extraction pins during final movement of said force plate means toward said second limit position retracted away from said one side of said grid, whereby to cause said extraction plate means to slide along said blunted pins back to a position generally flush with the outer ends of said blunted pins and thereby strip any portions of said commodity clinging to and wedged between the outer ends of said blunted pins from the latter.

2. The dicer of claim 1 wherein said knife means includes a knife blade extending generally radially outwardly of a central area of said grid.

3. The dicer of claim 1 wherein said knife means is mounted for angular placement about an axis centered relative to said center area and disposed generally normal to said grid.

4. The dicer of claim 3 wherein said knife means includes a pair of generally diametrically opposite and radially extending knife blades with their cutting edges disposed in the first-mentioned plane.

5. The dicer of claim 1 including an upwardly opening generally horizontal trough relative to one end of which said grid is supported and in and through which said force means is disposed and movable for movement toward and away from said one side of said grid.

6. The dicer of claim 5 wherein said grid is removably supported relative to said trough and is upwardly removable therefrom.

7. The dicer of claim 1, wherein said dicer includes a standard having means on its lower end for stationary support from a suitable upwardly facing support surface, said standard including an upper end from which an upwardly opening horizontal trough is mounted, the opposite ends of said trough including opposite end plates, said grid being stationarily supported from one end plate and upwardly removable therefrom, upper and lower meshed gears journaled from the other end plate, said force means including a screw shaft centrally and slidably received through said upper gear with the latter keyed to said screw shaft for rotation therewith, releasable nut means supported from said other end plate through which said screw shaft is releasably threaded, said force plate means being rotatably mounted on the end of said screw shaft opposing said grid, a crank handle on the end of said screw shaft remote from said force plate means, a pair of opposite side elongated guides extending between said end plates, said force plate means including opposite side followers guidingly engaged with said guides, the ends of said guides remote from said other end plate extending beyond said one end plate, a bearing plate mounted between the extended ends of said guides and rotatably journaling a second pair of meshed upper and lower gears therefrom, a jack shaft extending between and drivingly connecting said lower gears, said knife means being carried by the last-mentioned upper gear between said bearing plate and said one end plate, said force plate means including a force plate from which the end of said screw shaft remote from said crank handle is journaled and from which said followers are supported and a plate member upwardly removable from said force plate and from which said blunted pins are supported, said extraction plate means being mounted on said blunted pins for removal from the forward ends thereof when said force means is shifted to said second limit position, the spacing between said force plate and said one end plate when said force means is in said second limit position being sufficient to enable complete withdrawal of said extraction pins through said plate member and from between the free ends of said blunted pins.

* * * * *